US009539830B2

(12) United States Patent
Abergel

(10) Patent No.: US 9,539,830 B2
(45) Date of Patent: Jan. 10, 2017

(54) DEVICE AND METHOD FOR TRANSPORTING SUBSTRATES IN A PRINTING MACHINE

(71) Applicant: MGI FRANCE, Irvy sur Seine (FR)

(72) Inventor: Edmond Abergel, Paris (FR)

(73) Assignee: MGI FRANCE, Ivry sur Seine (FR)

( * ) Notice: Subject to any disclaimer, the term of this patent is extended or adjusted under 35 U.S.C. 154(b) by 0 days.

(21) Appl. No.: 14/395,395

(22) PCT Filed: Apr. 17, 2013

(86) PCT No.: PCT/EP2013/058030
§ 371 (c)(1),
(2) Date: Oct. 17, 2014

(87) PCT Pub. No.: WO2013/156540
PCT Pub. Date: Oct. 24, 2013

(65) Prior Publication Data

US 2015/0137445 A1 May 21, 2015

(30) Foreign Application Priority Data

Apr. 17, 2012 (FR) ..... 12 53534

(51) Int. Cl.
*B41J 13/22* (2006.01)
*B65H 5/08* (2006.01)
(Continued)

(52) U.S. Cl.
CPC ..... *B41J 13/22* (2013.01); *B41J 15/165* (2013.01); *B65H 5/08* (2013.01); *B65H 5/085* (2013.01); *B65H 7/02* (2013.01); *B65H 7/20* (2013.01); *B65H 37/00* (2013.01); *B65H 2301/44331* (2013.01); *B65H 2405/55* (2013.01); *B65H 2511/20* (2013.01); *B65H 2513/10* (2013.01); *B65H 2515/31* (2013.01); *B65H 2555/132* (2013.01); *B65H 2701/1311* (2013.01); *B65H 2701/1313* (2013.01); *B65H 2801/21* (2013.01)

(58) Field of Classification Search
None
See application file for complete search history.

(56) References Cited

U.S. PATENT DOCUMENTS 3,413,732 A * 12/1968 Koch ..... B41F 23/044 101/416.1
4,409,741 A 10/1983 Bonomi
(Continued)

FOREIGN PATENT DOCUMENTS

DE 199 01 698 8/1999
DE 101 29 094 2/2003
(Continued)

OTHER PUBLICATIONS

International Search Report for corresponding International Application No. PCT/EP2013/058030, mailed Jul. 25, 2013.

*Primary Examiner* — Justin Seo
(74) *Attorney, Agent, or Firm* — Hauptman Ham, LLP

(57) ABSTRACT

The invention relates to a novel device and a novel method for transporting printable substrates in a precise manner, suitable for various types, sizes and thicknesses of substrate. The invention is also suitable for printing machines that do not come into contact with the substrate, such as ink-jet printing machines.

32 Claims, 4 Drawing Sheets

Figure 1:
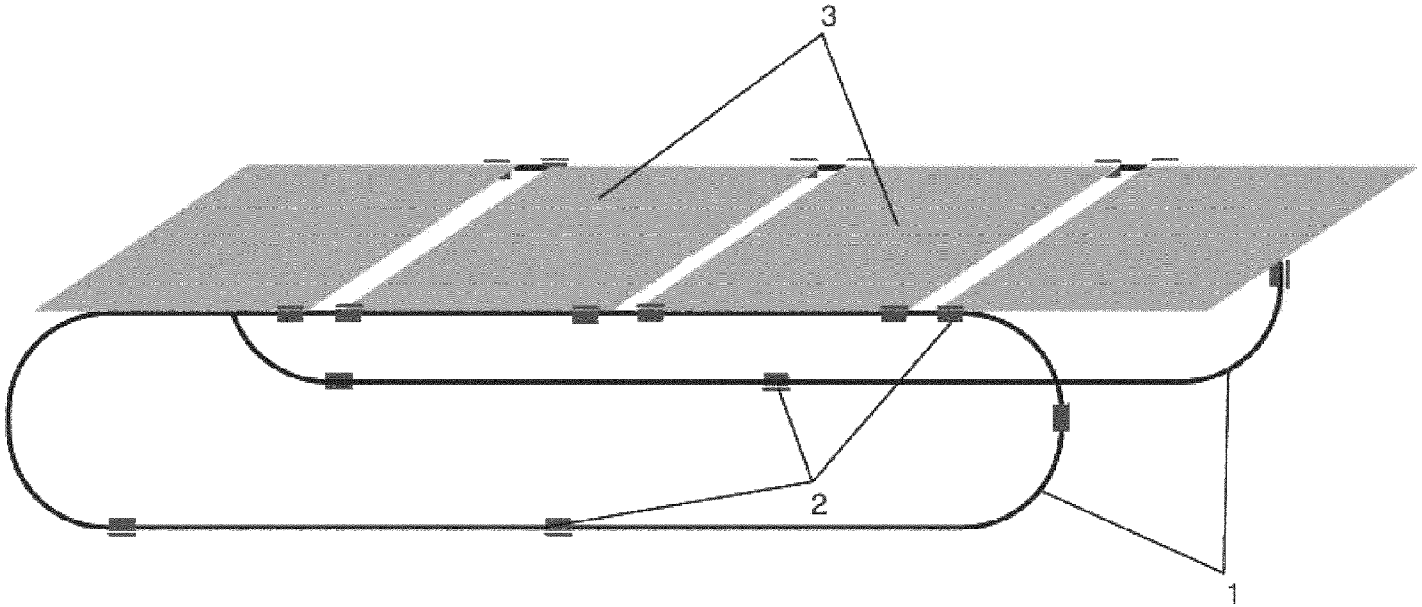

(51) Int. Cl.

| | |
|---|---|
| ***B41J 15/16*** | (2006.01) |
| ***B65H 7/02*** | (2006.01) |
| ***B65H 7/20*** | (2006.01) |
| ***B65H 37/00*** | (2006.01) |

(56) References Cited

U.S. PATENT DOCUMENTS

| | | | | |
|---|---|---|---|---|
| 4,693,462 | A * | 9/1987 | Pollich | B65H 29/686 271/183 |
| 5,431,386 | A | 7/1995 | Blaser | |
| 6,176,484 | B1 * | 1/2001 | Greive | B41F 21/08 198/470.1 |
| 6,315,287 | B1 * | 11/2001 | Hirth | B65H 29/686 271/182 |
| 7,641,195 | B2 * | 1/2010 | Suzuki | B65H 29/28 271/204 |
| 8,733,634 | B1 * | 5/2014 | Eastman | G07D 11/0081 235/375 |
| 2002/0129893 | A1 * | 9/2002 | Winter | B65H 1/22 156/283 |
| 2004/0080102 | A1 * | 4/2004 | Hachimann | B65H 5/228 271/264 |
| 2008/0088081 | A1 * | 4/2008 | Miwa | B65H 31/38 271/210 |
| 2008/0253820 | A1 * | 10/2008 | Baba | B65H 31/26 399/410 |
| 2008/0293532 | A1 | 11/2008 | Angst et al. | |
| 2009/0184988 | A1 * | 7/2009 | Noro | B41J 11/42 347/1 |
| 2011/0068531 | A1 * | 3/2011 | Gentle | B65H 29/04 271/202 |
| 2011/0227280 | A1 | 9/2011 | Foerch et al. | |
| 2012/0031565 | A1 * | 2/2012 | Yokoyama | B65H 20/02 156/538 |

FOREIGN PATENT DOCUMENTS

| | | | | |
|---|---|---|---|---|
| DE | 10129094 | A1 * | 2/2003 | B41J 3/60 |
| DE | 1810825 | A2 * | 7/2007 | B41F 7/06 |
| DE | 102007028132 | A1 * | 12/2008 | B65H 29/041 |
| DE | 10 2011 011396 | | 9/2011 | |
| EP | 0 039 526 | | 12/1993 | |
| EP | 1 810 825 | | 7/2007 | |
| GB | 2 267 698 | | 11/2008 | |

* cited by examiner 20
1
22
21
22
1
23
3

DEVICE AND METHOD FOR TRANSPORTING SUBSTRATES IN A PRINTING MACHINE

TECHNICAL FIELD OF THE INVENTION

The present invention relates to the field of printing, in particular without contact with the substrates, and more particularly to a device and method for transporting printable substrates to all the workstations in a printing machine, the transport of substrates being carried out so as to enable their printing in optimal conditions.

TECHNOLOGICAL BACKGROUND OF THE INVENTION

Transport of printable substrates formed by suction belts in known from the prior art, the function of which is to hold and keep a substrate against said belts as they move. This type of solution, well known to those skilled in the art, has a few disadvantages however. In particular, this type of device, causing movements of air and pressure gradients, can cause deformation of substrates if the latter are large in size. The precision of the printing will therefore be affected. On the other hand, the use of these suction belts with some wide used printing technologies, especially inkjet printing, can cause accidental aspiration of ink present in the printing heads and cause the deactivation of the printing heads. In the best of cases this genre of incident needs reactivating of the heads, and in the worst of cases replacement of the deactivated heads, the latter now unusable if connected to the ink tank.

To rectify these problems, especially to allow displacement of substrates precisely, there are in the prior art techniques using cylinders comprising a plurality of clamps gripping the substrates by the front edge relative to the direction of displacement of the substrate. Adapted to printing machines of inkjet type, this type of solution has several disadvantages however. Indeed, this system needs all the heads inkjet to be arranged orbitally around a large-sized cylinder. Also, this type of system poses the problem of the difficulty in adjusting the position of the printing heads. In fact, for quality printing, ink ejected from the printing heads must form a jet whereof the direction is perpendicular to the surface of the substrate. It is understood in this case that the use of a cylinder to transport and hold the substrate, whereof the surface by definition is not flat, means intricate adjusting of the position of the printing heads. For this same reason, it is difficult to use substrates of variable thickness, as the change of substrate means adjusting all the printing heads. On the other hand, the printing pitch, that is, the position of the clamps on the cylinder, is fixed, meaning that the printing rate remains the same irrespective of the size of the substrate.

Also known from the prior art are substrate transport systems using chains or conveyors on which clamps are arranged to grip the substrates and transport them on a transport path whereof a portion is flat, resolving the problem of arrangement of the printing heads. However, this type of solution always has the problem of fixed printing pitch, which imposes a fixed rate and in this case poses the extra problem of not being able to use substrates of different sizes without stopping printing and proceeding with intricate adjusting of the position of the clamps.

GENERAL DESCRIPTION OF THE INVENTION

The aim of he present invention is to resolve at least one of the problems of the prior art, as explained hereinabove.

The invention proposes a novel device and a novel method for transporting printable substrates precisely, adapted to substrates of various types, sizes and thicknesses. In particular, the invention produces printing at variable pitch. Also, the invention is adapted to printing machines without contact with the substrate, such as inkjet printing machines.

For this purpose, the invention relates to a substrate transport system in a printing machine, along a transport path oriented according to a longitudinal axis from at least one entry store supplying the printable substrates to at least one exit store receiving the substrates, characterized in that it comprises:

- mobile gripping means, each comprising an opening/closing system ensuring release or gripping of a substrate, said gripping means comprising front and rear gripping means, each gripping either a substrate, respectively front and rear, or a part located, respectively, to the front and the rear of the same substrate, along the transport path,
- guide means for guiding the gripping means along the transport path,
- at least one motorisation means ensuring displacement of the gripping means (2) along guide means (1), preferably with independent displacement between at least the front gripping means (2) and the rear gripping means (2), the substrate transport system being adapted to grip each substrate so as to tense and/or move substrates, even if they have variable sizes (in particular variable lengths), along the transport path, the guide means, the gripping means and their associated opening/closing system being controlled by computer facilities.

Other particular features and advantages of the substrate transport system are detailed in the present application. An additional aim of the invention is to propose a method for transport and tensioning of printable substrates.

For this purpose, the invention relates to a method for tensioning and transport of substrates along a transport path, executed by the substrate transport system according to the invention, characterized in that it comprises the following steps:

a. positioning in an area near the entry store, by said at least one motorisation means actuated by the computer facilities, of at least one first gripping means, called front gripping means, following detection of the front transversal edge (for example detection of the speed and/or of the position) of a substrate relative to the direction of displacement, b. displacement of the front gripping means at a speed adapted to that of the substrate, and positioning of said gripping means in an area near the front part of the substrate, the computer facilities executing the information on speed and position of the substrate to control the speeds and synchronisation of the gripping means as a function of the position of the substrates along the transport path, c. closing of the front gripping means by the opening/closing system on at least one edge of the substrate, said gripping means from now on driving the substrate, d. positioning then synchronised displacement at a speed adapted to that of the front gripping means, and closing on at least one edge of the substrate, of at least one second gripping means, called rear gripping means, e. tensioning of the substrate located between the front and rear gripping means.

f. opening of the opening/closing system of the front gripping means when the position of the latter is in an area near the exit store of the printing machine, g. opening of the opening/closing system of the rear gripping means, at the end of a time $t_1$ dependent on distance, before opening, between the front and rear gripping means, followed by slowing of said gripping means so as to release the substrate, h. return of the gripping means in a storage area near the entry store.

Other particular features and advantages of the method for tensioning and transport of substrates are detailed in the present application.

The invention, with its characteristics and advantages, will emerge more clearly from the description given in reference to the appended drawings, in which:

FIG. 1 schematically illustrates a three-dimensional view of the substrate transport system according to some embodiments.

Figure 2:
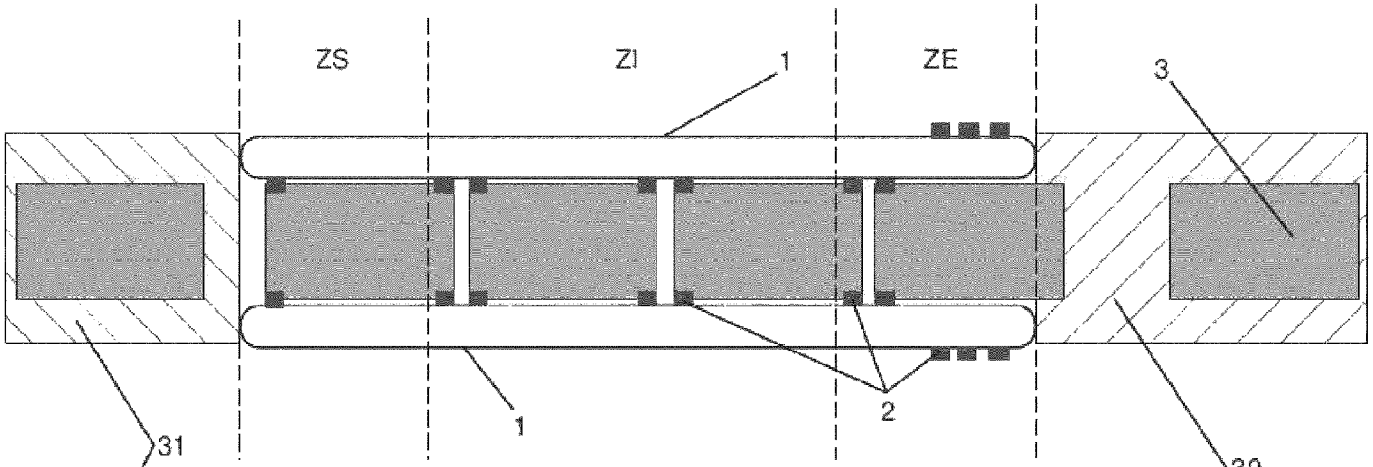

FIG. 2 schematically illustrates a first embodiment of the invention.

Figure 3:
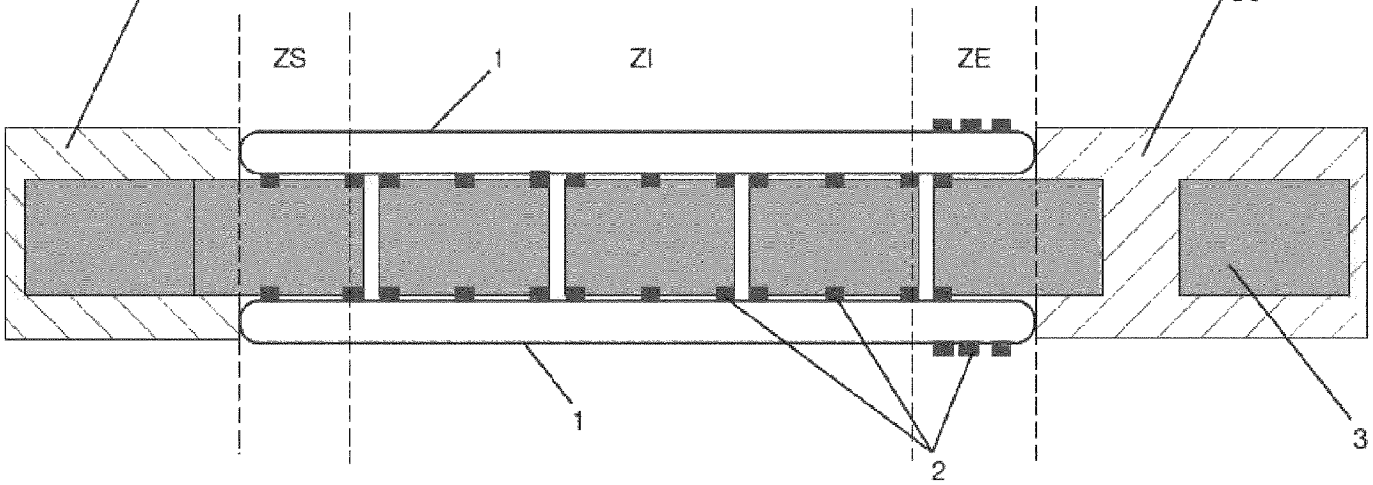

FIG. 3 schematically illustrates a second embodiment of the invention.

Figures 4A, 4B, 4C:
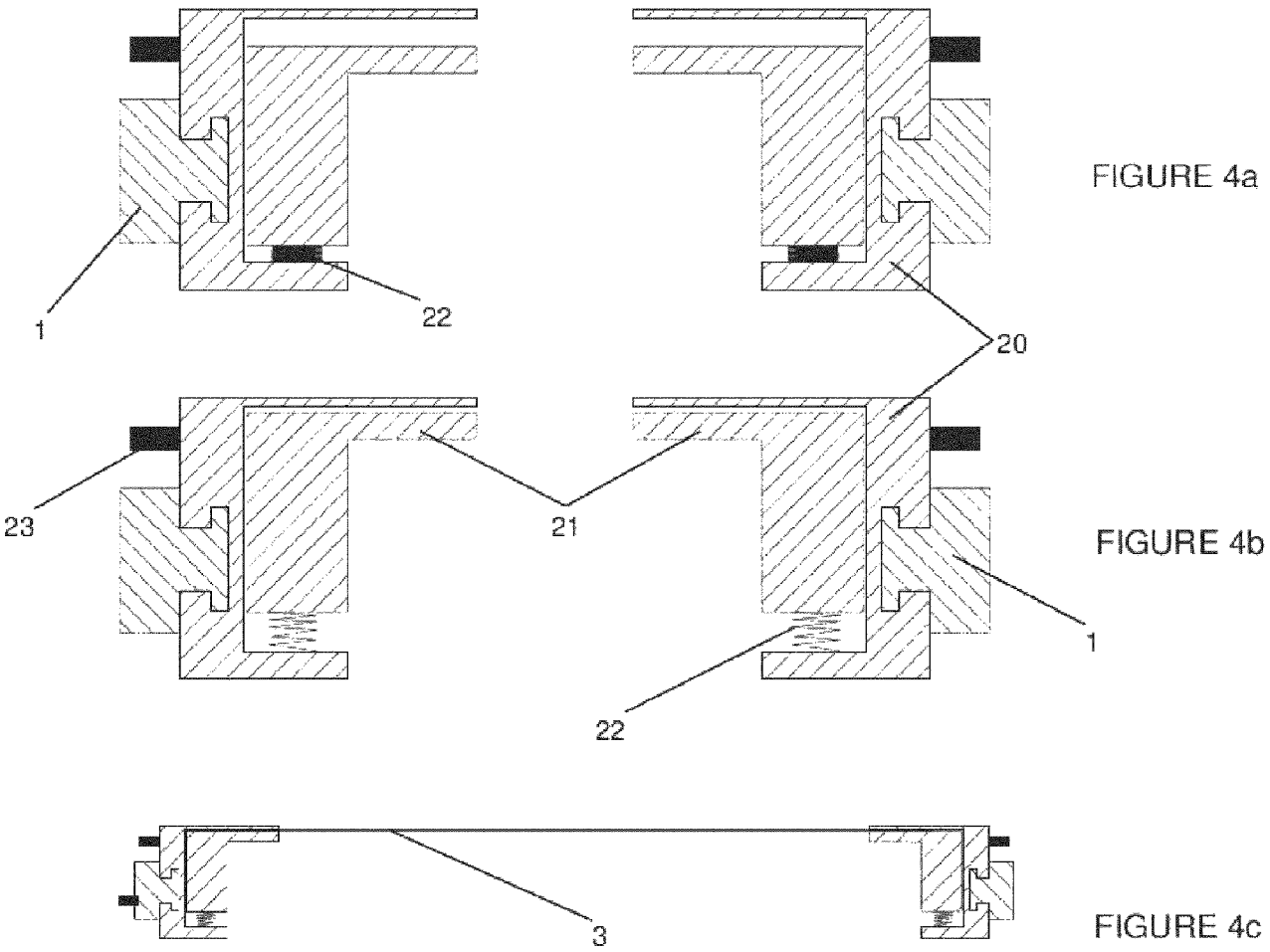

FIG. 4*a* illustrates a pair of gripping means in the open position, the mobile part ensuring the opening being opposite the verso of the substrate, the recto being the printable face opposite the printing heads.

FIG. 4*b* illustrates a pair of gripping means in closed position, the mobile part ensuring the opening being opposite the verso of the substrate, the recto being the printable face opposite the printing heads.

FIG. 4*c* illustrates a pair of gripping means holding a substrate by its lateral edges.

Figure 5:
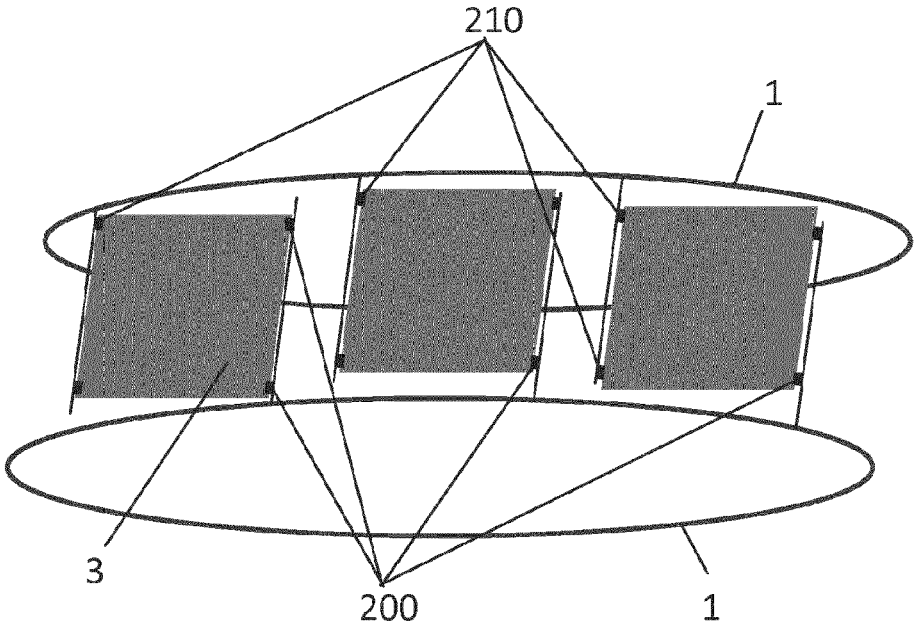

FIG. 5 schematically illustrates a third embodiment of the invention.

DESCRIPTION OF PREFERRED EMBODIMENTS OF THE INVENTION

The present invention relates to a device or system (the two terms here being used randomly) for transport of substrates, as well as a method for transport and tensioning of substrates. The substrate transport system is described hereinbelow in reference to the figures, but it is clear that the figures and the examples provided in the present application are illustrative and non-limiting. Said substrate transport system is comprised in a printing machine, for example and in a non-limiting way an inkjet printing machine. The machine is controlled by computer facilities which control especially the different workstations, by controlling according to configuration parameters (dependent especially on the substrates), their devices, systems or means (motorisation, gripping, guiding, detection). The computer facilities can also collect information from different detection means (sensors for example) to coordinate the operations of various stations, devices, systems and means of the machine. These computer facilities have not been detailed in the present application and they could for example be integrated into the machine or sent to a separate device or system. From information of positions of substrates, the sensors give information of configurations of substrates (3) and/or information on validation following an operation completed correctly or not. Some information necessary for executing the invention can also be loaded previously in the computer facilities (for example via input on an interface by an operator). Such information can for example relate to the size of the substrates or their thickness, but it is generally preferred that sensors measure or verify such information. The substrates (3) waiting for printing are generally, as known per se, placed in at least one entry store (30) having a capacity defined as a function of the nature of the substrate (3) and printing needs. In an embodiment, an entry store (30) is provided to accept several thousand substrates (3) variable in nature, thickness and dimension (for example and in a non-limiting way a credit card format to AO format). Once the printing method is over, the substrates (3) are stored in at least one exit store (31) generally having the same capacity as an entry store. A device for gripping the substrates (3) withdraws the substrates (3) from the entry store (30) and places them on drive means, for example the transport system of substrates whereof the characteristics will be detailed later in the description, to move them along a work chain generally comprising several workstations, for example and in a non-limiting way at least one printing station comprising a plurality of inkjet printing heads controlled by the computer facilities, followed by a drying station. In general, checks are also made to detect the presence of a single substrate (3) to each station of the conveyor. The printing machine performs printing from one substrate to the other with variable pitch, using the transport system as detailed hereinbelow. This means that the printing machine is capable of adapting use of the printing heads and the transport speed of the substrates (3) as a function of the size of the substrates (3), for example by way of sensors installed on the printing machine. In some embodiments, the printing machine is equipped with a device for turning over the substrates (3), allowing recto-verso printing of said substrates.

In some embodiments, and in illustrative and non-limiting reference to FIGS. 4*a* to 4*c*, the substrate transport system (3) comprises mobile gripping means (2), moving along a transport path oriented according to a longitudinal axis, for example between an entry store (30) supplying printable substrates (3) and an exit store (31) receiving the printed substrates (3). The transport path is defined by the plane in which the substrates move and oriented according to the longitudinal axis. For example, the substrates (3) can be blank, or comprise already printed patterns. In some embodiments, these gripping means (2) are clamps, a term to be used throughout the description illustratively and non-limiting to designate the gripping means (2) in general. Each clamp (2) comprises an opening/closing system (22) for gripping or releasing the substrates in convoy along the transport path (or print path). This opening/closing system (22) is controlled (23) by the computer facilities. Each clamp comprises a fixed part (20) and a mobile part (21), or two mobile parts, movement of which grips or releases a substrate (3).

In the present description, the substrates, the clamps or the edges of substrates which are located towards the exit store are designated by the term "front", whereas those located towards the entry store are designated by the term "rear", in reference to the direction of displacement of the substrates in the printing machine. On the other hand, the term "lateral" means the elements located on either side of the longitudinal axis of the transport path. Finally, the term "inserted" designates the clamps gripping a substrate at a level located between the front and the rear of this substrate (therefore between the front and rear clamps). It is understood that these designations are conventional and are not limiting. In some embodiments, the clamps (2) controlled by the computer facilities grip each substrate (3) in an area near the four corners of the substrate. But, according to the configuration (especially control made by the computer facilities), various clamps can grip the substrates in different places, especially on the front and/or rear edges and/or on the lateral edges.

In some embodiments, the mobile part (21) of each clamp (2) is located opposite the recto of each substrate (3), the recto being the printable face of the substrates (3) located opposite the printing heads. These embodiments in general facilitate release of substrates, especially when the clamps move away from the substrate in the direction of the verso face when they have released the substrate (for example in the case of a conveyor in closed circuit). In other generally preferred embodiments the mobile part (21) of the clamps is located opposite the verso of each substrate (3) in convoy. This arrangement limits the risks of contact of the mobile part with the printing heads. On the other hand, the position of the printing heads is generally adjustable at least in the direction of the height (perpendicularly to the plane of the transport path), avoiding any contact between the mobile part (21) of the clamps (2) and the printing heads. This adjustable height is particularly advantageous in the embodiments where the mobile part is on the recto side and in the embodiments where the mobile parts are both on the recto side and on the verso side. Finally, the opening/closing system (22) of the clamps is for example controlled by an electromagnet, or a rail system.

In some embodiments, the substrate transport system comprises guide means (1) of clamps (2), arranged over the entire length of the transport path of the substrates (3). Incorrect language can designate such guide means under the term of displacement means of motorised clamps, but here the designation of guiding is preferred, especially because the clamps can comprise motorisation or only a passive part of motorisation. For example and in a non-limiting way, these guide means (1) of the clamps are guides, rails or runners, arranged along the transport path of the substrates (3). In some embodiments, the guide means form a closed circuit whereof a "going" part forms the transport path and a "return" part forms a return path of the clamps towards the entry store. The term "guide" is used in the present description to designate the guide means (1) illustratively and non-limiting. In some embodiments each displacement guide (1) forms a closed circuit which can be for example an oblong shape, each guide (1) being in a plane parallel to the plane of the substrates (that is, of the transport path). In alternative embodiments, each guide is in a plane perpendicular to the plane of the substrates (3).

In some preferred embodiments, the transport system of the substrates (3) comprises two guides (1) comprising a plurality of clamps (2), each guide (1) being arranged on either side of the transport path of the substrates (3). In some of these embodiments, the substrate transport system can comprise a plurality of guides (1) arranged in pairs, on either side of the transport path, the distance between the guides (1) of each pair being different to enable adaptation of the substrate transport system (3) to substrates (3) of different size, in particular variable width. In some preferred embodiments, the substrate transport system (3) comprises two guides (1) arranged on either side of the transport path of the substrates (2), whereof the transversal width is variable and controlled by the computer facilities, the substrate transport system (3) able to adapt to any size of substrate (3). In some embodiments, whereof a non-limiting example is illustrated schematically in FIG. 5, the substrate transport system (3) comprises two guides (1) arranged on either side of the transport path of the substrates (3), whereof the transversal width is variable and controlled by the computer facilities, the first guide (1) comprising at least one clamp (200) for gripping at least one front portion of a substrate (3), the second guide (1) comprising at least one clamp (210) for gripping at least one rear portion of the same substrate (3).

The present application defines front gripping means and rear gripping means. These are at least one front clamp (200) and at least one rear clamp (210) since, such as shown for example in FIG. 5, it is possible to have a pair of front clamps (200) and a pair of rear clamps (210), but it is possible to have just one front clamp and one rear clamp. Also, these are front and rear part or portions of the substrate (or a part located at the front or rear) as it is possible to grip a front edge and a rear edge such as for example in FIG. 5, but it is possible to grip a part or portion of the lateral edges located near the front of the substrate and a part or portion of the lateral edges located near the rear of the substrate (in general the two lateral edges are gripped rather than a single lateral edge, according to the rigidity of the substrate). Reference is therefore made both to front gripping means gripping at least one part located at the front and also to rear gripping means gripping at least one part located at the rear (whether a front/rear edge or a lateral edge located to the front/rear). On the other hand, the front and rear gripping means can in fact each grip a substrate, respectively front and rear, that is, a first substrate (called "front") first on the transport path and a second substrate (called "rear") which follows the first and can have a size different to the first. For example, a single front clamp grips a first substrate, called front, for example at the level of its front edge or a lateral edge, while a single rear clamp grips a second substrate, called rear, for example at the level of its front edge or a lateral edge. It is possible to also grip each of the front and rear substrates by at least two clamps which jointly form one of the front or rear gripping means.

In some embodiments, the transport system of substrates (3) comprises detection means of the speed and/or of the position of the clamps (2) along the transport path, said detection means being controlled by the computer facilities (for example comprised in the printing machine). For example and in a non-limiting way, each clamp (2) can comprise a position sensor and/or a speed sensor connected to the computer facilities. In preferred embodiments, said speed and/or position sensors are integrated into the motorisation means, said motorisation means being controlled by the computer facilities, and allowing the clamps (2) to move along the guides (1), in turn arranged along the transport path.

In some embodiments, the transport system for substrates (3) comprises detection means of substrates (generally for detection of the front edge) when the latter enter the transport path, for example as soon as they exit from the entry store. These detection means, controlled by the computer facilities, are for example and in a non-limiting way sensors comprised in at least one entry store (30). For example and in a non-limiting way, this sensor is an optical coder or an optical ruler. These detection means can detect for example the speed and/or the position of substrates. Detecting the front edge can suffice to the extent where the computer facilities know the speed of the substrates exiting from the entry store, but the speed could also be detected to optimise exploitation of this information by the computer facilities. So, the substrate transport system is therefore adapted in some embodiments to detect the speed of substrates (3) and allow the clamps (2) moving along the guides (1) to grip each substrate so as to move it along the transport path oriented according to the longitudinal axis.

In some embodiments, the substrate transport system (3) is also configured to tension the substrates (3), the tension force being applied by the clamps (2) holding the substrate at least in the longitudinal axis so as to facilitate their transport and heighten printing precision. For example and in a non-limiting way, the clamps (2) comprise a device for applying transversal tension in a controlled manner (that is, perpendicularly to the longitudinal axis of the transport path) to the substrate, for example at the level of the opening/closing system (22) to apply tension during closing of the clamps. Such a device for transversal tensioning can for example and in a non-limiting way comprise suction skates moving away transversally just before the closing of said clamps (2) on the substrate (3). The tension applied is parameterised by means of the computer facilities as a function of the elasticity of the substrate and its width. In some embodiments non-exclusive to those with transversal tension hereinabove, longitudinal tension (that is, parallel to the longitudinal axis of the transport path) is applied to the substrate, as detailed herein below.

The transport system for substrates (3) comprises at least one guide (1) on which is installed a plurality of gripping means (2) and at least one motorisation means for moving the gripping means (2) (or clamps). As mentioned earlier, the gripping means, especially front and rear, can in fact comprise a single clamp for gripping the substrates on a single edge. In this case, the substrates are preferably gripped by their front edge, but it is also possible optionally to grip them by a lateral edge, especially in the case of sufficiently rigid substrates (optionally relative to their size) to be held in this way. In some embodiments, displacement of the clamps (2) is controlled by pairs, each of the clamps of each pair being generally arranged at the same level along the longitudinal axis (since the substrates are generally rectangular). In some of these embodiments, the clamps are independent but their displacement is synchronised per pair. In other embodiments, each clamp (2) is connected to the other clamp of the pair located of the other side of the longitudinal axis of the transport path of the substrates (3). Preferably, the substrate transport system (3) is adapted to grip each substrate so as to hold and/or move substrates (3) of variable sizes (especially of variable length) along the transport path. In fact, the transport system comprises at least one motorisation means (for example controlled by the computer facilities, especially as a function of the substrates to be printed) ensuring displacement of the gripping means (2) along the guide means (1), with independent displacement between at least the front gripping means (2) and the rear gripping means (2). So, by controlling the speed of the front and rear clamps, it is possible to (longitudinally) tense the substrates irrespective of their sizes (in length in this case, the tension in width being managed by the transversal tension device). Such tensed substrates can be moved on the transport path or be kept immobile, for example during printing with mobile printing heads or during drying (therefore an example of the alternative to tensing, without forcibly moving). On the other hand, in the event where the front and rear gripping means each grip a substrate, respectively front and rear, as explained previously (by a single clamp each, for example), the substrates held in this way, without longitudinal tension, can be moved in the printing machine and independent displacement on the front and rear gripping means moves substrates of variable sizes (therefore an example of the alternative to moving, without forcibly tensing, substrates of variable sizes)

In some embodiments, said at least one motorisation means comprises motor means equipping the gripping means (2). A motor can for example equip the clamps (2), individually or per pair, to move the clamps along the guide means. So, in some of these embodiments, each gripping means (2) comprises at least one motor means ensuring its displacement along the guide means (1).

In some embodiments, said at least one motorisation means comprises at least one passive part equipping the gripping means (2) and at least one active part equipping the guide means (1). In such embodiments, the passive part integrated into the clamps enables displacement of the latter, for example controlled individually or in pairs, on the guide means which comprise the active part or, optionally, which are parallel to the active part. In fact, in some of these embodiments, said active part of the motorisation means comprises at least one linear motor. Also, in some of these embodiments, said at least one linear motor is installed on at least one rail parallel to the guide means (1). On the other hand, in some embodiments, the transport system comprises at least two guide means (1) on which the gripping means (2) move. In this way, it is possible to have several motorisation means (e.g., linear motors) on the guides. In some of these embodiments, such as for example in the case of FIG. 5, said at least two guide means (1) comprise at least one guide means on which the front gripping means (2) move and at least one guide means on which the rear gripping means (2) move. Finally, as explained previously, the clamps are preferably controlled in pairs (for better gripping and/or tension of substrates). In this way, in some embodiments, the transport system comprises pairs of gripping means (2), each comprising two gripping means (2) located on the same side, front or rear, of the same substrate, with displacement of a pair of gripping means (2) being ensured by the same motorisation means, along at least one guide means (1).

In some embodiments, the substrate transport system (3) comprises one motorisation means per clamp (2). For example and in a non-limiting way, motorisation of the clamps (2) is effected by linear motors. In embodiments, two clamps (2), whereof the coordinates along the longitudinal axis are substantially the same, and which are installed on guides (1) located on either side of the transport path, are connected to the same linear motor. It is evident, so as not to subject the substrates (3) to shearing forces which could cause their deformation or their tearing, that the speed of the clamps (2) gripping the same substrate (3) is synchronised.

In some embodiments, the linear motors are installed on at least one rail parallel to the guides (1) on which are installed the clamps (2). In some embodiments, the linear motors are integrated into the guides (1). For example and in a non-limiting way, only the passive part of the linear motorisation is associated with at least one clamp (2), the active part being installed on each guide (1) or on a rail parallel to the guides (1), according to the embodiments.

In some embodiments, a substrate support (3), of adjustable position along an axis perpendicular to the substrate (3) so as to optimise the distance of the substrate (3) from the printing heads of the printing machine, is integrated within the printing machine between the input (30) and exit stores (31). For example and in a non-limiting way a sole is placed along the transport path between the input (30) and exit stores (31). To optimise the distance of the substrate (3) from the printing heads of the printing machine, the substrate support (3) is adjustable in a plane perpendicular to the substrates (3). In some embodiments, the substrate support has a profile slightly incurved so as to accentuate longitudinal tensioning of the substrates (3) in convoy. In preferred embodiments, the substrate support (3) comprises a plurality of openings, for example and non-limiting alveoli, to avoid lifting the substrates moving along the transport path due to aerodynamic effects, well known to those skilled in the art such as for example the lubrication phenomenon. In some embodiments, to adapt to the different widths of substrates used, the substrate support is adjustable transversally.

The computer facilities, for example comprised in the printing machine, control opening and closing of the clamps (2), evaluate the speed and/or position of the mobile elements, and finally deliver the command and control signals of the motorisation means (for example the linear motor or the linear motors).

Another aim of the invention is to propose a method for tensioning and transport of substrates (3) along a transport path, executed by various embodiments of the substrate transport system (3) described previously. The different successive steps characterising this method and its possible variants as per various embodiments will now be described, in reference to FIGS. 1 to 5 by way of illustration and non-limiting.

First, note that the printable substrate (3) passes successively through all stations constituting the printing machine, from the entry store (30) to receipt of substrates in the exit store (31), and that the machine comprises only one printing station, preferably with a drying station, or several printing or personalisation stations known per se. In general, the computer facilities control the opening and closing of the gripping means (2), evaluate the speed of displacement of the mobile elements, and deliver the command and control signals of the motorisation means (for example the linear motors).

It is evident that in the case of linear motors, the speeds and/or position of the clamps are generally known due to the fact that the latter which are passive only are controlled actively. It is possible to do away with detection means of clamps, even though it is generally preferred to add them to ensure proper operation of the system and avoid damaging the elements of the system.

In some embodiments, the method is characterized in that it comprises the following steps:

a. positioning in an area near the entry store (30), by said at least one motorisation means actuated by the computer facilities, of at least one first gripping means (2), called front gripping means, following detection of the front transversal edge of a substrate (3) relative to the direction of displacement, b. displacement of the front gripping means (2), at a speed adapted to that of the substrate (3), and positioning of said gripping means (2) in an area near the front part of the substrate (3), the computer facilities executing information on speed and position of the substrate (3) to control the speeds and synchronisation of the gripping means (2) as a function of the position of the substrates (3) along the transport path, c. closing of the front gripping means (2) by the opening/closing system (22) on at least one edge of the substrate (3), said gripping means (2) from now on driving the substrate (3), d. positioning then synchronised displacement at a speed adapted to that of the front gripping means (2), and closing on at least one edge of the substrate (3), of at least one second gripping means (2), called rear gripping means, e. tensioning of the substrate (3) located between the front and rear gripping means (2).

f. opening of the opening/closing system (22) of the front gripping means (2) when the position of the latter is in an area near the exit store (31) of the printing machine, g. opening of the opening/closing system (22) of the rear gripping means, at the end of a time $t_1$ dependent on distance, before opening, between the front and rear gripping means (2), followed by slowing of said gripping means (2) so as to release the substrate (3), h. return of the gripping means (2) in a storage area near the entry store (30).

It is understood from these embodiments that the clamps (2) successively grip the substrate as it enters the transport path. In some embodiments, the clamps can be positioned previously relative to each other as a function of the respective positions in which they must grip the substrate (according to the configuration controlled by the computer facilities for example). In such embodiments, steps a to e are replaced by the following steps:

a", positioning of all the gripping means (2) along the same substrate, in an area near the entry store (30) simultaneously with detection of the front edge of a substrate (3) (for example detection of the speed and/or of the position), b". synchronised displacement of the gripping means (2) at a speed adapted to the substrate (3), controlled by the computer facilities executing (or relaying) information on speed and position of the substrate (3), c". closing of the gripping means (2) by the opening/closing system (22), said gripping means (2) from now on driving the substrate (3), d". a step for tensioning the substrates (3) by the gripping means (2).

As already mentioned in the present application, the transport system can comprise guide means in closed circuit. In such embodiments, steps f to h of the method are replaced by the following steps:

f'. opening of the opening/closing system (22) of the front gripping means (2), followed by acceleration of said front gripping means (2) so that they continue their displacement on the guide means (1) and return to a storage area near the entry store (30), g', opening of the opening/closing system (22) of the rear gripping means, at the end of a time $t_2$ dependent on distance, before opening, between the front and rear gripping means (2), followed by slowing of the rear gripping means so as to release the substrate (3) then acceleration so that the rear gripping means (2) continue their displacement on each guide (1) and return to a storage area near the entry store (30).

As already mentioned in the present application, the clamps (2) can grip the substrates by the lateral edges. The closing steps of the clamps will preferably take place on the lateral edges of the substrates. This is valid also for the front and rear clamps, but the latter can also grip the substrates by the edges, respectively, front and rear (when gripping the same substrate with the front and rear clamps) or respectively grip an edge (preferably a front edge or a lateral edge) of a front substrate and an edge (preferably a front edge or a lateral edge) of a rear substrate.

In some embodiments, the transversal distance between two guide means (1) located on either side of the longitudinal axis of the transport path is variable. The method could therefore comprise at least one step for adjusting this distance between the guide means, for example as a function of the sizes of substrates located on the transport path.

In some embodiments, the method comprises a step for transversal tensioning of the substrate (3), performed by transversal tension means comprised in the gripping means (2) and controlled by the computer facilities. This step is generally performed during or following closing of the gripping means (2).

As already mentioned in the present application, the invention enables longitudinal tensioning of the substrates, and advantageously irrespective of their sizes. In some embodiments of the method, the step for tensioning of the substrate (3) between two consecutive gripping means (2) is performed by the computer facilities by applying a drop Δv in the speed of the gripping means (2) located farthest to the rear relative to the direction of displacement of the substrate (3), over a time Δt to create a difference Δd=Δv×Δt between the gripping means (2) dependent on the physical characteristics of the substrate (3), the speed of the gripping means (2) again being synchronised at the end of the time Δt. In some embodiments of the method, the step for tensioning of the substrate (3) between two consecutive gripping means (2) is performed by the computer facilities such that the motorisation mean or motorisation means connected to the gripping means (2) located farthest to the rear relative to the direction of displacement of the substrate (3) exert a force directed in the direction opposite the direction of displacement of the substrate (3), the intensity of the force being parameterised as a function of the physical characteristics of the substrate (3).

It is possible to have only one front clamp per substrate or only one pair of front clamps, but it is preferable to also have at least one rear clamp, especially to enable tensioning, but this would be only for better guiding of the substrates on the transport path. Also, it is often preferable, especially when the substrates are of significant size (for example of A4 format), to have at least one inserted clamp (preferably a pair of clamps). In this way, in various embodiments, the substrate transport system (3) comprises inserted gripping means located between the front and rear gripping means. In such embodiments, the method comprises repetition, for each of these inserted gripping means, of steps (d, d", e, g and g") relating to the rear gripping means. In particular, in some embodiments, the substrate transport system comprises n pairs of gripping means (2) for each of the transported substrates, n being greater than or equal to 2, the pairs comprising at least one front pair and one rear pair, and optionally n−2 inserted pairs. The description of the steps of the method hereinbelow is given in reference to such embodiments comprising inserted clamps.

During the first step of the method, noted a, when a substrate (3) leaves an entry store (30) by means of the gripping device, the position at a given instant and the speed of said substrate (3) are measured by a sensor, for example installed inside an entry store (30), the sensor able to be for example and in a non-limiting way an optical coder detecting the front transversal edge of the substrates (30) leaving a store (30), the term front being defined relative to the direction of displacement of the substrates (3). This information on position and speed is sent to the computer facilities which in response control the signal actuating at least one linear motor. The linear motor will enable movement of a first pair of clamps (2), said clamps being located on either side of the transport paths of the substrates (3) and having substantially equal longitudinal coordinates to position said pair of clamps (2) in an area near an entry store (30), said area being called entry area (ZE). For example and in a non-limiting way, part of the substrate (3) is considered as being in the entry area (ZE) as long as fewer than two pairs of clamps (2) have gripped the longitudinal edges of said part of substrate (3). In this entry area, no printing is provided.

During the second step, noted b, the first pair of clamp (2) positioned in the preceding step adopts synchronised displacement at a speed adapted to that of the substrate (3) exiting from the entry store (30), so as to be positioned in an area of the longitudinal edge near the front part of the substrate (3). For example and in a non-limiting way, each clamp (2) of the first pair grips a front corner of the substrate (3). The positioning and the speed of the pair of clamps (2) are adapted as a function of the information on speed and position of the substrate (3) logged by the computer facilities. Said computer facilities execute this information on speed and position of the substrate (3) to control speeds and synchronisation of the clamps (2) as a function of the position of the substrate along the transport path. In some embodiments, the speed of the first pair of clamps (2) synchronises with the substrate speed (3) and positions at the level of the front corners of said substrate (3). In other embodiments, the speed of the substrate (3) once it has left the entry store is zero, the motorisation of the first pair of clamps (2) positioning the latter at the level of the front corners of the substrate, before stopping.

During the third step, noted c, the opening/closing system (22) of each clamp (2) of the first pair is actuated by the computer facilities. The result is closing of the first pair of clamp (2) on the longitudinal edges of the substrate (3), said substrate from now on being driven by the clamps (2).

During the fourth step, noted d, a second pair of clamps (2), each clamp being located on either side of the transport path and having substantially equal longitudinal coordinates, is positioned in the entry area (ZE) by actuation of the linear motor by the computer facilities. The speed of the second pair of clamps (2) is adapted to the speed of the first pair of clamps (2), the second pair of clamps (2) being positioned in an area near the longitudinal edges of said substrate (3), excluding at least the front corners, so that the opening/closing mechanism (22) actuates the mobile parts (21) of said clamps (2) so as to grip the substrate (3) on the longitudinal edges of the substrate (3). From the moment when at least two pairs of clamps (2) have gripped the substrate (3) to ensure the convoy, the substrate (3) returns to the printing area (ZI), and the portions of the substrate (3) between the clamps (2) can be subjected to printing any pattern.

During the fifth step, noted e, the portion of substrate (3) between the two pairs of clamps (2) which has gripped said substrate (3) is tensed mechanically. In embodiments, this step for tensioning of the substrate (3) between two consecutive pairs of clamps (2) is performed in the following manner: the computer facilities send a signal to the motor of the pair of clamps (2) located farthest to the rear relative to the direction of displacement of the substrate (3), so that a drop in speed noted Δv is applied to the motor(s) of the rearmost pair of clamps (2). This drop in speed is applied over a time Δt, controlled by the computer facilities, to create a gap Δd=Δv×Δt between the pairs of clamps (2), this distance Δd dependent on the physical characteristics of the substrate (3) being tensioned. On completion of a time Δt, the speed of the two pairs of clamps (2) is again synchronised by a signal sent by the computer facilities to the motors of said pairs of clamps (2). In other embodiments, the step for tensioning the substrate between two consecutive pairs of clamps (2) is performed as follows: the computer facilities send a signal to the motor(s) of the pair of clamps (2) located farthest to the rear relative to the direction of displacement of the substrate (3), such that the motor(s) of said pair of clamps (2) exert a longitudinal force directed in the direction opposite the direction of displacement of the substrate (3), the intensity of the force being parameterised by means of the computer facilities as a function of the physical characteristics of the substrate (3).

In some embodiments, force sensors comprised in the clamps (2) measure the tension force existing at the level of the gripping area of the substrate (2). In this way, when the measured force reaches the threshold defined for the substrate (3) in question, the computer facilities send the motors a signal for synchronisation of speed ensuring displacement of the clamps (2) along the guides (1).

To ensure the convoy of substrates (3) along the workstations of the printing machine, the fourth and fifth steps (d and e) are repeated for the remaining n−2 pairs of clamps (2). The pairs of clamps (2) are equidistant, and the last pair of clamps (2), located farthest to the rear relative to the direction of displacement of the substrate (3), is positioned in an area of the longitudinal edge of the substrate (3) near the rear part of the substrate (3). For example and in a non-limiting way, the last pair of clamps (2) grips the corners rear of the substrate (3). The convoy and tensioning of the substrate (3) are therefore ensured by the n pairs of clamps (2) having gripped the longitudinal edges of said substrate (3) and motorised on the guides (1) arranged on either side of the transport path.

During the seventh step, noted g, when the substrate (3) in convoy due to the guides (1) and the clamps (2) arrives near an exit store, the computer facilities send a signal to the opening/closing system (22) of the first pair of clamps (2), located the farthest in front relative to the direction of displacement of the substrate (3), so that said opening/closing system (22) actuates displacement of the mobile part (21) of the clamps (2) of the first pair, releasing the substrate (3), for example and in a non-limiting way at the level of the front corners. This part of the substrate (3), between the released front transversal edge and the following pair of clamps (2) still gripping the substrate, is not located in an area called output area (ZS). A part of the substrate (3) is in an output area (ZS) when the maximum is one pair of clamps (2) gripping the part of substrate (3) at the level of the longitudinal edges. In this output area (ZS), no printing is provided. The greater the number n of pair of clamps (2) in the transport system of the substrates (3), the more the size of the input areas (ZE) and output areas (ZS) decrease to the benefit of the printing area (ZI). In some embodiments, when the substrate (3) is released from the first pair of clamps (2), the motor controlling the latter slows to a stop of said pair of clamps (2) in an area near an exit store (31).

During the eighth step, noted h, at the end of a time $t_1$ dependent on the speed and/or of the length of the substrate (3) the computer facilities send a signal to the opening/closing system (22) of the pair of clamps (2) located just to the rear of the first pair of clamps (2) located the farthest in front, so that said opening/closing system (22) actuates displacement of the mobile part (21) of the clamps (2) of the second pair. The computer facilities then send a signal to the motor(s) of the second pair of clamps (2) so that the latter slows down, releasing the substrate (3).

This eighth step is repeated for the following n−2 pairs of clamps (2), as far as the last pair located farthest to the rear of the substrate (3) relative to the direction of displacement, for example and in a non-limiting way at the level of the rear corners of the substrate (3).

The ninth step, noted i, the computer facilities send the motors n pairs of clamps (2) a return signal of the clamps (2) to a storage area of guides (1), an area near an entry store (30), the motors stopping when the position detection means detect that the clamps (2) are present in this storage area.

The method for tensioning and transport of substrates is applicable to a substrate transport system comprising guides (1) forming closed circuits. In these particular embodiments, the steps g to i described previously are replaced by the following steps.

In a seventh alternative step, noted g, due to the guides (1) and the clamps (2) when the substrate (3) in convoy arrives near an exit store (31), the computer facilities send a signal to the opening/closing system (22) of the first pair of clamps (2), located the farthest to the front relative to the direction of displacement of the substrate (3), so that said opening/closing system (22) actuates displacement of the mobile part (21) of clamps (2) of the first pair, releasing the substrate (3), for example and in a non-limiting way at the level of the front corners. This part of the substrate, between the released front transversal edge and the pair of clamps still gripping the substrate (3), is now located in the output area (ZS). When the substrate is released from the first pair of clamps (2), the motor controlling the latter accelerates the pair of clamps (2) such that the pair of clamps (2) continues its displacement along the guides (1) and returns to a storage area near an entry store (30). In some embodiments, when the guides (1) are in a plane parallel to the plane of the substrate (3), the clamps move away from the substrate (3) in a plane parallel to said substrate (3), just after the clamps (2) have released the substrate.

In an eighth alternative step, noted h, send at the end of a time $t_2$ dependent on the speed and/or of the length of the substrate (3) the computer facilities a signal to the opening/closing system (22) of the pair of clamps (2) located just to the rear of the first pair of clamps (2) located the farthest to the front, so that said opening/closing system (22) actuates displacement of the mobile part of the clamps (2) of the second pair. The computer facilities then send a signal to the motor(s) of the second pair of clamps (2) so that the latter slows down, releasing the substrate (3), then an acceleration signal of the pair of clamps (2) is sent to the motors via the computer facilities so that said pair of clamps (2) continues its displacement along guides (1) and returns to a storage area near an entry store (30).

These two steps are repeated for the remaining n−2 pairs of clamps (2), as far as the last pair located farthest to the rear of the substrate (3) relative to the direction of displacement, for example and in a non-limiting way at the level of the corners rear of the substrate (3).

In some embodiments, the first six steps of the method (a to f), are replaced by the following steps.

In a first alternative step, noted a, the n pairs of clamps (2) are positioned in the entry area (ZE) along guides, the clamps (2) of a same pair being installed on either side of the transport path, the clamps (2) being positioned following detection by the detection means of the speed and position of the substrate (3) leaving an entry store (30), for example and in a non-limiting way detection of the front transversal edge of the substrate (3).

In a second alternative step, noted b, the n pairs of clamps (2) positioned in the preceding step adopt synchronised displacement at a speed adapted to that of the substrate (3) exiting from the entry store (30). The positioning and speed of the pairs of clamps (2) are adapted as a function of information on speed and position of the substrate (3) logged by the computer facilities. Said computer facilities exploit this information on speed and position of the substrate (3) to control speeds and synchronisation of the clamps (2) as a function of the position of the substrate (3) along the transport path. In other embodiments, the speed of the substrate (3) once it leaves the entry store is zero, the motorisation of n pairs of clamps (2) adapting as a consequence.

In a third step alternative, noted c, the opening/closing system (22) of each clamp (2) of n pairs is actuated by the computer facilities. The result of this is closing of all the clamps (2) on the longitudinal edges of the substrate (3), said substrate from now on being driven by the clamps (2).

In a fourth step, noted d, the n−1 parts of substrate (3) between the n pairs of clamps (2) are tensed mechanically.

In an alternative embodiment, each pair of clamps (2) is substituted by a single clamp (2) adapted to grip the substrate (3), for example over all or part of the width of the lateral edge of the substrate (3). In this case, the transport and tensioning method of the substrate (3) can be executed by means of two clamps (2) per substrate (3), each gripping a lateral edge of the substrate. Positioning of clamps (2), adaptation of the speed of clamps (2) to that of the substrate (3), gripping the lateral edges of the substrate (3), tensioning of the substrate (3), release of the substrate (3) and return of the clamps (2) to the storage area can be done according to the method described previously.

The present application describes various technical characteristics and advantages in reference to the figures and/or various embodiments. Those skilled in the art will understand that the technical characteristics of a given embodiment can in fact be combined with characteristics of another embodiment unless specified otherwise or it is evident that these characteristics are incompatible. Also, the technical characteristics described in a given embodiment can be separated from the other characteristics of this mode unless specified otherwise.

It must be evident for experts that the present invention enables embodiments in many other specific forms without departing from the field of application of the invention as claimed. Consequently, the present embodiments must be considered by way of illustration, but can be modified within the field defined by the scope of the appended claims, and the invention must not be limited to the details given hereinabove.

The invention claimed is:

1. A system for transporting substrates (3) in a printing machine, along a transport path oriented according to a longitudinal axis from at least one entry store (30) supplying the printable substrates, to at least one exit store (31) receiving the substrates, characterized in that it comprises:

mobile gripping means (2) each comprising an opening/closing system (22) ensuring the release or gripping of substrate (3), said gripping means (2) comprising front and rear gripping means, gripping each, either a substrate, respectively front and rear, or a part located at the front and at the rear of the same substrate, along the transport path, guide means (1), for guiding the gripping means (2) along the transport path, at least one motorisation means ensuring displacement of the gripping means (2) along the guide means (1), with independent displacement between at least the front gripping means (2) and the rear gripping means (2), the substrate transport system (3) being adapted to grip each substrate so as to tense and/or move substrates (3) of variable sizes along the transport path, the guide means (1), the gripping means (2) and their associated opening/closing system (22) being controlled by computer facilities.

2. The system for transporting substrates (3) according to the preceding claim, characterized in that it comprises detection means of the speed and/or of the position of the gripping means (2) on the transport path, these detection means being controlled by the computer facilities.

3. The system for transporting substrates (3) according to any one of the preceding claims, characterized in that said at least one motorisation means comprises motor means equipping the gripping means (2).

4. The system for transporting substrates (3) according to the preceding claim, characterized in that each gripping means (2) comprises at least one motor means ensuring its displacement along the guide means (1).

5. The system for transporting substrates (3) according to any one of claims 1 and 2, characterized in that said at least one motorisation means comprises at least one passive part equipping the gripping means (2) and at least one active part equipping the guide means (1).

6. The system for transporting printable substrates according to claim 1, wherein the system comprises at least two guides means on which the grippers are configured to move.

7. The system for transporting substrates (3) according to the preceding claim, characterized in that said at least two guide means (1) comprise at least one guide means on which the front gripping means (2) move and at least one guide means on which the rear gripping means (2) move.

8. The system for transporting substrates (3) according to any one of the preceding claims, characterized in that it comprises pairs of gripping means (2), each comprising two gripping means (2) located on the same side, front or rear, of the same substrate, displacement of a pair of gripping means (2) being ensured by the same motorisation means along at least one guide means (1).

9. The system for transporting substrates (3) according to any one of the preceding claims, characterized in that the gripping means (2) controlled by the computer facilities grip each substrate (3) at least in an area near the four corners of the substrate (3).

10. The system for transporting substrates (3) according to any one of the preceding claims, characterized in that the gripping means (2) comprise transversal tension means of the substrate (3), said transversal tension means being controlled by the computer facilities.

11. The system for transporting printable substrates according to claim 1, wherein a substrate support, of adjustable position along an axis perpendicular to the plane of the substrate so as to optimise the distance from the substrate to the printing heads of the printing machine, is integrated within the printing machine between the entry stores and exit stores.

12. The system for transporting substrates (3) according to any one of the preceding claims, characterized in that it comprises detection means of the speed and/or of the position of the substrates (3) connected to the computer facilities.

13. The system for transporting substrates (3) according to any one of the preceding claims, characterized in that the guide means (1) comprise guides arranged on either side of the longitudinal axis of the transport path of the substrates (3).

14. The system for transporting substrates (3) according to claim 13, characterized in that each guide (1) forms a closed circuit.

15. The system for transporting substrates (3) according to the preceding claim, characterized in that the guides (1) are arranged in a plane perpendicular to the plane of the substrates (3).

16. The transport system according to claim 14, characterized in that the guides (1) are arranged in a plane parallel to the plane of the substrates (3).

17. The system for transporting substrates (3) according to any one of claims 4 to 16, characterized in that said active part of the motorisation means comprises at least one linear motor.

18. The system for transporting substrates (3) according to the preceding claim, characterized in that said at least one linear motor is installed on at least one rail parallel to the guide means (1).

19. The system for transporting printable substrates according to claim 1, wherein the grippers comprise a mobile part for gripping or release of the substrates, the mobile part being located opposite the recto of the substrate, the recto being the printable face opposite the printing heads.

20. The system for transporting printable substrates according to claim 1, wherein the grippers comprise a mobile part for gripping or release of the substrates, the mobile part being located opposite the verso of the substrate, the verso being the face opposite to the printable face which is opposite the printing heads.

21. The system for transporting substrates (3) according to any one of the preceding claims, characterized in that each gripping means (2) is adapted to grip a lateral edge of the substrate (3).

22. A method for tensioning and transport of substrates along a transport path, executed by the substrate transport system according to claim 1, wherein the method comprises the following steps:

a. positioning the front grippers in an area near the entry store, by said at least one motorisation actuated by the computer facilities, following detection of the front transversal edge of the substrate relative to the direction of displacement,
b. displacement of the front grippers, at a speed adapted to that of the substrate, and positioning of said grippers in an area near the front part of the substrate, the computer facilities exploiting information on speed and position of the substrate to control the speeds and synchronisation of the grippers as a function of the position of the substrates along the transport path,
c. closing of the front grippers by the opening/closing system on at least one edge of the substrate, said grippers from now on driving the substrate,
d. positioning and synchronizing displacement of the rear grippers to a speed adapted to that of the front grippers, and closing the rear grippers on at least one edge of the substrate,
e. tensioning the substrate located between the front and rear grippers,
f. opening of the opening/closing system of the front grippers when the position of the front grippers is in an area near the exit store of the printing machine,
g. opening of the opening/closing system of the rear grippers, at the end of a time $t_1$ dependent on the distance between the front and rear grippers when the front and rear grippers are all gripping the substrate, followed by slowing down of the rear grippers so as to release the substrate,
h. return of the grippers in a storage area near the entry store.

23. A method for tensioning and transport of substrates along a transport path, executed by the substrate transport system according to claim 1, wherein the method comprises the following steps:

a. positioning the front grippers in an area near the entry store, by said at least one motorisation actuated by the computer facilities, following detection of the front transversal edge of the substrate relative to the direction of displacement,
b. displacement of the front grippers, at a speed adapted to that of the substrate, and positioning of said grippers in an area near the front part of the substrate, the computer facilities exploiting information on speed and position of the substrate to control the speeds and synchronisation of the grippers as a function of the position of the substrates along the transport path,
c. closing of the front grippers by the opening/closing system on at least one edge of the substrate, said grippers from now on driving the substrate,
d. positioning and synchronizing displacement of the rear grippers to a speed adapted to that of the front grippers, and closing the rear grippers on at least one edge of the substrate,
e. tensioning of the substrate located between the front and rear grippers,
f. opening of the opening/closing system of the front grippers, followed by acceleration of said front grippers, so that they continue their displacement on the guides and return to a storage area near the entry store,
g. opening of the opening/closing system of the rear grippers, at the end of a time $t_2$ dependent on the distance between the front and rear grippers when the front and rear grippers are all gripping the substrate, followed by slowing of the rear grippers so as to release the substrate, then acceleration so that the rear grippers continue their displacement on each of the guides and return to the storage area.

24. A method for tensioning and transport of substrates along a transport path, executed by the substrate transport system according to claim 1, wherein the method comprises the following steps:

a. positioning of all the grippers along the same substrate, in an area near the entry store simultaneously with detection of the front edge of a substrate,
b. synchronised displacement of the grippers at a speed adapted to the substrate, controlled by the computer facilities executing the information on speed and position of the substrate,
c. closing of the grippers by the opening/closing system, said grippers from now on driving the substrate,
d. tensioning of the substrates by the grippers
e. opening of the opening/closing system of the front grippers when the position of the front grippers is in an area near the exit store of the printing machine,
f. opening of the opening/closing system of the rear grippers, at the end of a time $t_1$ dependent on the distance between the front and rear grippers when the front and rear grippers are all gripping the substrate, followed by slowing down of said grippers so as to release the substrate,
g. return of the grippers in a storage area near the entry store.

25. The method for tensioning and transport of substrates (3) according to any one of claims 22 to 24, characterized in that at least some of the gripping means (2) grip the substrates on their lateral edges.

26. The method for tensioning and transport of substrates (3) according to the preceding claim, characterized in that the substrate transport system (3) comprises inserted gripping means located between the front and rear gripping means, and in that the method comprises repetition, for each of these inserted gripping means, of steps (d, d", e, g and g') relating to the rear gripping means.

27. The method for tensioning and transport of substrates (3) according to any one of claims 22 to 26, characterized in that the substrate transport system comprises n pairs of gripping means (2) for each of the transported substrates, n being greater than or equal to 2, the pairs comprising at least one front pair and one rear pair, and optionally n−2 inserted pairs.

28. The method for tensioning and transport of substrates (3) according to any one of claims 22 to 27, characterized in that the transversal distance between two guide means (1) located on either side of the longitudinal axis of the transport path is variable.

29. The method for tensioning and transport of substrates (3) according to any one of claims 22 to 28, characterized in that a step for transversal tensioning of the substrate (3), performed by transversal tension means comprised in the gripping means (2) and controlled by the computer facilities, is performed following closing of the gripping means (2).

30. The method for tensioning and transport of substrates according to claim 22, wherein the step for tensioning of the substrate between two consecutive grippers is performed by the computer facilities by applying a decrease $\Delta v$ in the speed of the grippers located farthest to the rear relative to the direction of displacement of the substrate, over a time $\Delta t$, to create a difference $\Delta d=\Delta v\times\Delta t$ between the grippers dependent on the physical characteristics of the substrate, the speed of the grippers again being synchronised at the end of the time $\Delta t$.

31. The method for tensioning and transport of substrates (3) according to any one of claims 22 to 30, characterized in that the step for tensioning of the substrate (3) between two consecutive gripping means (2) is performed by the computer facilities such that the motorisation means connected to the gripping means (2) located farthest to the rear relative to the direction of displacement of the substrate (3) exert a force directed in the direction opposite the direction of displacement of the substrate (3), the intensity of the force being parameterised as a function of the physical characteristics of the substrate (3).

32. The method for tensioning and transport of substrates (3) according to any one of claims 22 to 31, characterized in that the computer facilities control the opening and closing of the gripping means (2), evaluate the speed of displacement of the mobile elements, and deliver the command and control signals of the linear motors.

* * * * *